US005092406A

United States Patent [19]

McStravick

[11] Patent Number: 5,092,406

[45] Date of Patent: Mar. 3, 1992

[54] APPARATUS FOR CONTROLLING WELL CEMENTING OPERATION

[75] Inventor: David M. McStravick, Houston, Tex.

[73] Assignee: Baker Hughes Incorporated, Houston, Tex.

[21] Appl. No.: 721,109

[22] Filed: Jun. 26, 1991

Related U.S. Application Data

[63] Continuation of Ser. No. 462,714, Jan. 9, 1990, abandoned.

[51] Int. Cl.[5] ..... E21B 34/10

[52] U.S. Cl. ..... 166/321; 166/327

[58] Field of Search ..... 166/285, 321, 325, 327

[56] References Cited

U.S. PATENT DOCUMENTS

| | | | |
|---|---|---|---|
| 2,161,282 | 6/1939 | Crowell | 166/327 X |
| 3,385,272 | 5/1968 | Knox | 166/285 X |
| 3,385,370 | 5/1968 | Knox et al. | 166/285 X |
| 3,957,114 | 5/1976 | Streich | 166/285 |
| 4,270,569 | 6/1981 | Reay et al. | 166/325 X |
| 4,391,328 | 7/1983 | Aumann | 166/325 |
| 4,399,871 | 8/1983 | Adkins et al. | 166/325 |
| 4,469,174 | 9/1984 | Freeman | 166/285 X |
| 4,624,316 | 11/1986 | Baldridge et al. | 166/325 |
| 4,712,619 | 12/1987 | Stepp et al. | 166/327 |
| 4,771,831 | 9/1988 | Pringle et al. | 166/321 X |

FOREIGN PATENT DOCUMENTS

| | | | |
|---|---|---|---|
| 2147641 | 5/1985 | United Kingdom | 166/285 |
| 2172031 | 9/1986 | United Kingdom | 166/285 |

*Primary Examiner*—William P. Neuder

*Attorney, Agent, or Firm*—Rosenblatt & Associates

[57] ABSTRACT

To significantly reduce voids in cementing fluids and the effects of cement free fall encountered in well cementing operations, a differential pressure control regulator is inserted in series with the bottom of the well casing to be cemented. Fluid passing through the choke portion passes through an annular valve seat to one end of the tool. A valve stem is slidably and sealably mounted in the flow regulator and has a head portion which, in one position, can contact the valve seating surface and prevent any significant flow of fluid through the casing. The valve stem is biased to one position by a trap chamber filled with a fluid at a known pressure, such as atmospheric pressure, or a vacuum, so that the hydrostatic pressure existing at the bottom of the well casing normally urges the valve head into engagement with the valve seat. Increasing the pressure within the casing, as a consequence of pumping cement, forces the valve head away from the valve seat and permits fluid flow only with a positive surface pumping pressure which minimizes the occurrence of voids in the cement.

7 Claims, 2 Drawing Sheets

APPARATUS FOR CONTROLLING WELL CEMENTING OPERATION

This is a continuation of co-pending application Ser. No. 462,714 filed on Jan. 9, 1990 now abandoned.

BACKGROUND OF THE INVENTION

1. Field of the Invention

The invention relates to an apparatus for controlling the flow rate of cementing fluid pumped into a well casing to effect the cementing of the casing in a well bore by flow downwardly through the casing, out the bottom end of the casing and upwardly around the casing.

2. Summary of the Prior Art

Substantially every cementing operation faces the problem of cement "free fall". The densities of commonly used cementing fluid substantially exceed that of well fluids and drilling mud which are present within the casing and in the annulus between the exterior of the casing and the well bore at the beginning of the cementing operation. As a result, when a cementing fluid is pumped into the well casing, the hydrostatic pressure on the well fluids at the bottom of the casing is significantly increased, causing a large rate of return flow of the well fluids upwardly around the casing, such rate of flow being substantially in excess of the flow rate of the cement being introduced into the casing. As a result, the imbalance between the densities of typical cements and muds leads to a period where the heavy column of cement in the casing "falls" away from the surface and that creates one or more void spaces in the upper portion of the casing. As a result, the surface lines are "on vacuum" and the pumps are pumping against zero gauge pressure. The return rate exceeds the pump rate part of the time and then is less than the pump rate in the later portion of the cementing operation.

The cement "free fall" condition can be aggravated by a much higher weight of cement contained in the casing bore compared to the total weight of mud, well fluids and little or no cement contained in the well bore annulus.

The condition of free fall leads to the following potential problems:

1. Any air sucked into the casing by leakage during free fall periods lead sto frothy cement;

2. High evaporation/low heat loss in cement under vacuum conditions can lead to dehydration of the cement;

3. Lower internal pressure while the vacuum pockets exist leads to higher collapse differential on the casing;

4. Water hammer results when pumping catches up with the cement column, and can cause damage to casing or surface equipment; and 5. Because the annulus flow rate can be higher or lower than the pump rate, this can result in non-turbulent flow during low flow rate periods while higher annulus flow rates lead to additional back pressure on production formations.

While the fre fall problem has existed for many years, the industry has yet to develop a satisfactory solution for eliminating or significantly reducing this problem.

The present invention is directed to each of these problems.

SUMMARY OF THE INVENTION

In accordance with this invention, a differential pressure control regulator which actuates upon a specific pressure ratio differential is installed at the bottom end of the casing to be cemented, preferably just above a conventional cement guide shoe. Fluid passing through the regulator passes through a constricted annulus defined between an annular sealing surface and a valve head which is axially movable relative to the annular sealing surface. The valve head is mounted on a stem portion which in turn is slidably and sealably mounted in a central bore having a counterbored portion which is closed at one end. The sealing cooperation between the stem portion and the central bore is such as to provide a trap chamber in a counterbore containing a gas at a known pressure, such as air at atmospheric pressure, or a vacuum. The result of the existence of such chamber is that with sufficient well hydrostatic pressure the valve head will move into engagement with the annular sealing surface when no pumping pressure is being applied at the top of the casing.

When pumping pressure is applied to the top of the casing, as by the introduction of a cementing fluid, the increased pressure will be translated down the column of fluid contained within the bore of the casing thus moving the head portion when sufficient pressure differential which excess a predetermined pressure ratio exists across the valve. So long as the surface pump pressure plus density imbalance between the casing and the annulus is sufficently large, to exceed the predetermined pressure ratio the valve will stay open, thus allowing pumping of the cement. By proper sizing of the valve seat, if the cement pumping is interrupted for any reason, the valve head portion will move to its closed position and the "free fall" of the cement column is prevented.

To prevent rapid movements of the valve head, the trap chamber may be partially filled with a liquid, and an enlarged shoulder is provided on the stem portion of the valve within the counterbore, thus producing a liquid dampening action on movements of the valve stem.

Those skilled in the art will recognize that the area of the seat and the area of the annular flow passage must be selected to conform to conditions encountered in the particular well being cemented, because of the presence of so many variables. For example, the density of the cementing fluid may vary over a range from 1.1 to 1.7 times higher than the density of the well fluids which are to be displaced by the cementing fluid. The depth of the well of course results in higher hydrostatic pressures at the bottom of the casing, thus changing the amount of bias on the valve head of the regulating valve. Accordingly, it is necessary to provide from three to five different configurations of seat area by using different valve heads to accommodate such variations. A substantial reduction in the number of different sizes may be effected by utilizing two of the aforementioned differential pressure control which operates on a predetermined pressure ratio connected in series relationship. When so connected, the wells requiring the higher pressure ratios may be handled by two valves each having dimensions that would ordinarily not accommodate such high pressure drops.

The pressure drop across each of the series connected regulating valves has the further advantage of reducing the fluid flow velocity through such valves required to achieve the desired total pressure drop and thus greatly reducing the erosion effects of such high fluid velocity.

Other advantages of the apparatus of this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
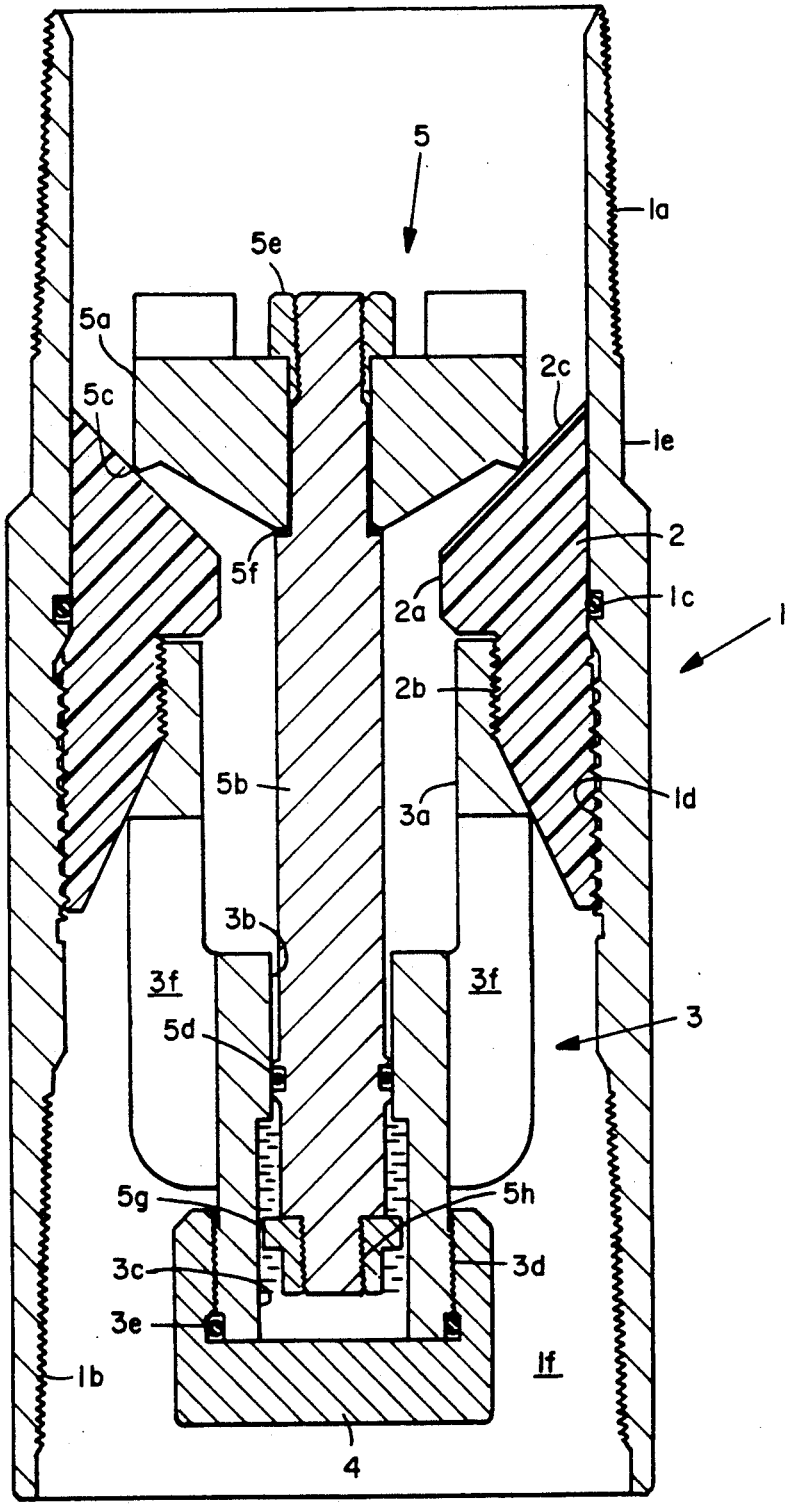
FIG. 1 is a vertical sectional view of a differential pressure control regulator embodying this invention with the valve shown in its closed position.

Referring to FIG. 1, there is shown a differential pressure control regulator 1 embodying this invention. Such apparatus is serially connected at one end by internal threads 1*b* to one end of well casing (not shown) extending to the top of the well. At its end, external threads 1*a* permit connection of the apparatus to a conventional cement guide shoe (also not shown). Such cement guide shoe is, of course, provided with fluid passages leading to the exterior of the casing and hence communicating with the annulus between the casing and the well bore.

The differential pressure control 1 has a tubular outer body portion 1*c* which is provided with internal threads 1*d* for mounting a tubular valve seat 2 within the bore of housing 1*c*. Threads 1*d* are sealed by an O-ring 1*e*. Valve seat 2 defines a conical valve seat 2*c*. Valve seat 2 defines a central choke bore 2*a* having internal threads 2*b* in a counterbore at the lower end thereof. A tubular valve stem housing 3 is mounted in threads 2*b*. The lower portion of the valve steam housing 3 is traversed by a small diameter central bore 3*b* and defines a larger upper bore 3*a*. Central bore 3*b* has a counterbore 3*c* at one end. An end cap 4 engages external threads 3*d* on valve stem housing 3 and such threads are sealed by O-ring 3*e*. A plurality of peripherally spaced fluid passages 3*f* are defined in the outer wall portions of valve stem housing 2 and communicates between the bore 3*a* and the annulus 1*f* in outer body portion lc.

A valve housing assembly 5 comprises an enlarged head portion 5*a* secured to a depending stem portion 5*b* by a nut 5*e* and gasket 5*f*. Head portion 5*a* is provided with a depending peripheral flange 5*c* which cooperates with conical valve seat 2*c*. When valve assembly 5 is in its closed position, as illustrated, fluid flow around valve head 5*a* is minimal, but the hydrostatic pressure existing in the casing is transmitted around the valve head 5*a*.

Valve stem 5*b* extends through central bore 3*b* and into the counterbore 3*c* of the valve stem housing 3. An O-ring 5*d* on valve stem 5*b* slidably and sealably cooperates with the central bore 3*b*, thus trapping a gas at known pressure, i.e., atmospheric pressure or a vacuum in a chamber defined by counterbore 3*c* with a signal dynamic seal.

If dampensing of the axial movements of valve assmebly 5 is desired, the trap chamber may be partially filled with liquid at the surface. A radial shoulder 5*g* may be provided on that portion of valve stem 5*b* lying within counterbore 3*c* to restrict flow of such liquid. Should 5*g* may comprise a nut secured to threads 5*h* on the top of valve stem 5*b*.

It will therefore be apparent that the valve head 5*a* is mounted for axial movements relative to the annular conical valve seat 2*c*. The valve head 5*a* is normally biased to the illustrated closed position relative to the annular seating surface 2*c* by the hydrostatic pressure existing at the bottom of the casing, which acts upon the differential presure area of bore 3*b* with the counterbore 3*c* containing air at atmospheric pressure or a vacuum. Thus when no fluid pressure is applied to the casing fluid and the well bore annulus other than the hydrostatic pressure, the valve head 5*a* will occupy the closed position relative to the annular seating surface 2*c*, and fluid flow through the differential pressure control regulator 1 is thus substantially eliminated. With a properly sized valve head, the problem of the free fall of any height column of cementing fluid contained in the casing above the flow regulating apparatus 1 when pumping is not occurring, is completely solved by the hydrostatic bias applied to maintain the valve head 5*a* in its closed position.

When the cement pumps are energiaed at the surface to pump cementing fluid down the bore of the casing, additional pressure is applied to the valve assembly 5, causing the valve head 5*c* to move to an open position as a predetermined pressure ratio is achieved wherein the annular flow area defined between the stationary conical surface 2*c* and the depending peripheral flange 5*c* formed on the valve head 5*a*, is less than or substantially equal to the flow area through the constricted bore portion 2*a*. Obviously the rate of the fluid flow through the regulator is determined by the dimensions of the bore area 2*a* and the afore described annular flow area.

It will therefore be readily apparent to those skilled in the art that the differential pressure control regulator 1 which actuates on reaching a predetermined pressure ratio heretofore described provides substantially complete assuarance that the flow rate of fluids out of the bottom end of the casing will always be sufficiently limited to prevent the occurrence of cement free fall and voids. More importantly, if the pumping of the cement is interrupted for any reason, the differential pressure control regulator 1 which actuates on reaching a predetermined pressure ratio functions solely in response to hydrostatic pressure to shift the valve head 5*a* into a closed position, thus substantially preventing any flow out of the casing and eliminating the possibility of the free fall of the heavier density cement contained in the upper portions of the casing string.

It will also be apparent to those skilled in the art that the number of variables inherent in the cementing of a plurality of wells would require substantial adjustments of the sizes of the valve head 5*a*, and the diameter of the sealing bore 3*b* defining the atmospheric pressure chamber, to prevent cement free fall. The relationship between these variables have been calculated and the results thereof are indicated graphically on FIG. 2. The vertical coordinate represents ratios of the upstream pressure to the downstream pressure to prevent free fall, meaning the ratio of fluid pressure exerted by the cement column contained in the casing to the fluid pressure existing below the differential pressure control regulator 1. The horizontal coordinate represents the ratio of the maximum height of the cement column to the well depth. Obviously, this would have a substantial effect on the flow rate of the fluid through the differential pressure control regulator 1.

Figure 2:
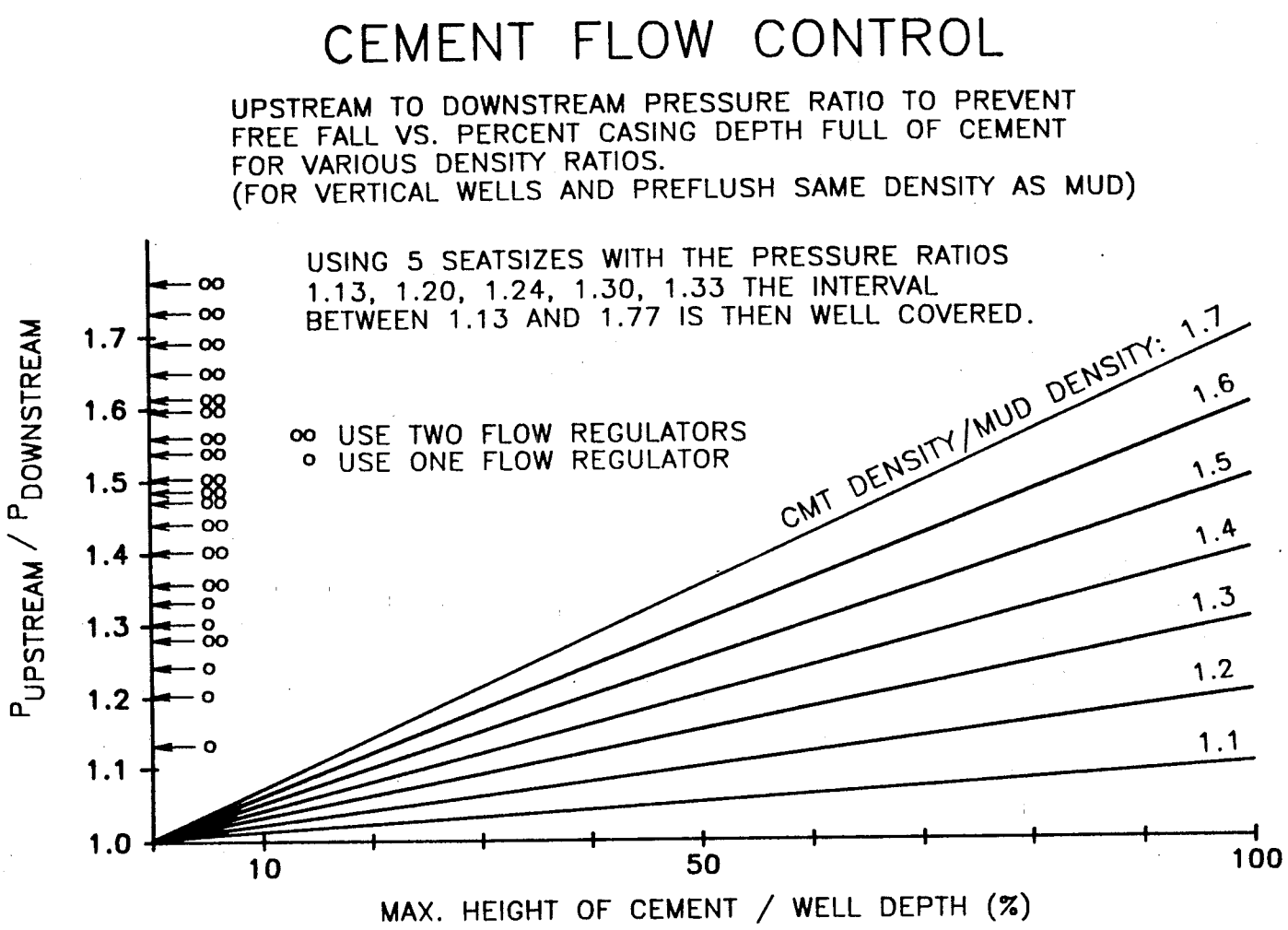
FIG. 2 is a charge illustrating the relationship of upstream-downstream pressure ratios, cement-mud density ratios and ratio of cement column to depth of well required to prevent cement free fall and voids.

The FIG. 2 chart indicates that the full range of the desired ratios of upstream to downstream pressure may be accommodated by utilizing only five different sizes of valve head flanges 5c. These five sizes will readily accommodate pressure ratios between 1.13 and 1.33. For higher pressure ratios, two of the differential pressure control regulator 1 are connected in series in the bottom portion of the casing above a cement guide shoe. With the two regulators in series, pressure ratios between 1.33 and 1.75 can be accommodated and hence the use of one or two regulators will prevent free fall of the cement for the various ratios of the cement density to mud density ranging from 1.1 to 1.7. From this chart, the desired ratio of upstream to downstream pressure may be calculated for the conditions encountered in a particular cementing opearation. Additionally, the need for utilizing two pressure control regulators in series for certain combinations of variables is clearly indicated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve apparatus to prevent cement freefall when cementing casing mounted adjacent to the lower end of the casing string, comprising:

a tubular housing;

valve seat means in said housing;

a valve member operable for selective engagement with said valve seat means between an open and a closed position;

means mounted to said housing for interaction with at least a portion of said valve member on a first side with respect to said valve said to provide resistance against forces acting on said valve member on a second side disposed on the opposite side of said valve seat;

said forces on said second side tending to keep said valve member aginst said valve seat until the ratio of the applied pressure on said member on said portion of said first side and the well fluid and/or cement on the balance of said first side compared to the opposing force on said second side exceeds a predetermined ratio, whereupon said valve member shifts to substantially its fully open position as said pressure ratio is achieved.

2. The apparatus of claim 1, wherein said resistance means further comprises:

a guide member adapted to accept said valve member;

sealing means to seal between said valve member and said guide member;

said guide member defining a chamber around a portion of said valve member, said chamber sealed by said sealing means;

said chamber varying in volume with movement of said valve member.

3. A valve apparatus to prevent cement freefall when cementing casing mounted adjacent to the lower end of the casing string, comprising:

a tubular housing;

valve seat means in said housing;

valve means operable for selective engagement with said valve seat means to operate the valve;

means mounted to said housing for interaction with at least a portion of said valve means on a first side with respect to said valve seat to provide resistance against forces acting on said valve means on a second side disposed on the opposite side of said valve seat;

said forces on said second side tending to keep said valve means against said valve seat until the ratio of the applied pressure of said means on said portion of said first side and the well fluid and/or cement on the balance of said first side compared to the opposing force on said second side exceeds a predetermined ratio;

said resistance means further comprises:

a guide member adapted to accept said valve means;

sealing means to seal between said valve means and said guide member;

said guide member defining a chamber around a portion of said valve means, said chamber sealed by said sealing means;

said chamber varying in volume with movement of said valve means;

said valve means further comprises:

a valve head and a stem extending from one side of said valve head into said chamber;

said sealing means sealing between said stem and said guide member;

said valve head adapted for contact with said valve seat when no cement is flowing into the casing.

4. The apparatus of claim 3, further comprising:

drag means on said portion of said stem disposed in said chamber to control the rate of movement of said valve head in response to applied pressure of cement on portions of said vlave head surrounding said stem.

5. The apparatus of claim 4, wherein:

said chamber is at least partially filled with a fluid;

said drag means extends beyond said stem to adjacent said guide means within said cavity to create a restricted flowpath in said cavity for said fluid to regulate the rate of movement of said valve head.

6. The apparatus of claim 5, wherein said drag means also acts as an open travel stop for said valve head by engagement with said guide means.

7. The apparatus of claim 6, further comprising:

at least one chamber;

at least two assemblies of said valve head, stem, seat, and guides;

whereupon by selective combinations of said assemblies, the ratio of pressures required to open the normally closed valve assemblies can be varied.

* * * * *